United States Patent [19]

Kaga et al.

[11] 4,448,409

[45] May 15, 1984

[54] CARTESIAN DIVING TOY

[75] Inventors: Takashi Kaga; Nobuo Kobayashi, both of Tokyo, Japan

[73] Assignee: Tomy Kogyo Co., Inc., Tokyo, Japan

[21] Appl. No.: 271,206

[22] Filed: Jun. 8, 1981

[30] Foreign Application Priority Data

Jul. 23, 1980 [JP] Japan ..... 55-103154

[51] Int. Cl.[3] ..... A63H 23/08

[52] U.S. Cl. ..... 272/8 N; 46/92

[58] Field of Search ..... 46/91, 92, 94; 272/8 R, 272/8 D, 8 N, 1 B; 273/1 L; 215/329, 231

[56] References Cited

U.S. PATENT DOCUMENTS

| | | | |
|---|---|---|---|
| 84,628 | 12/1868 | Hunter . | |
| 234,342 | 11/1880 | Stewart | 215/329 |
| 1,271,272 | 7/1918 | Bunkley . | |
| 2,345,243 | 3/1944 | Eakin | 46/92 |
| 2,525,232 | 10/1950 | McGaughy | 272/8 |
| 2,544,949 | 3/1951 | Daniel | 272/8 |
| 2,779,131 | 1/1957 | Scheithaver | 46/92 |
| 3,071,375 | 1/1963 | Moore | 272/8 |
| 3,334,439 | 8/1967 | Lodrick | 46/92 |
| 3,382,606 | 5/1968 | Johnson | 46/91 |
| 3,588,099 | 6/1971 | Todd | 272/8 |
| 3,924,350 | 12/1975 | Hsu | 46/92 |
| 3,998,349 | 12/1976 | Megowen | 215/231 |

FOREIGN PATENT DOCUMENTS

| | | | |
|---|---|---|---|
| 2084032 | 7/1982 | United Kingdom | 46/92 |

*Primary Examiner*—Richard J. Johnson
*Assistant Examiner*—William H. Honaker
*Attorney, Agent, or Firm*—Edward D. O'Brian; K. H. Boswell

[57] ABSTRACT

An improvement in Cartesian diving toy includes modification of both the diving component of the toy and of the receptacle in which the toy dives in. The diving toy includes an air chamber, a section of which is invaginated within the remaining section of the air chamber. The invaginated section is convoluted and is capable of extending or shortening in respect to pressure changes in the environment outside of the air chamber. A propulsion member is connected to the invaginated section of the air chamber and moves in response to the elongation or the shortening of the invaginated section to propel the toy through a liquid. The receptacle for the toy is improved by locating a pump chamber in association with the lower part of the receptacle allowing for complete purging of the air out of the pump chamber. The receptacle further includes a stopper having a protuberance on its lower side which fits within an upstanding wall on the upper portion of the receptacle. When the stopper is fitted onto the receptacle, the protuberance is forced into the upper surface of the liquid within the receptacle and displaces any gas within the upper periphery of the receptacle rendering the receptacle essentially gas free such that the liquid therein is capable of transmitting pressure differences from the pump directly to the air chamber of the diving component toy.

11 Claims, 6 Drawing Figures

CARTESIAN DIVING TOY

BACKGROUND OF THE INVENTION

This invention is directed to an improvement in a Cartesian diving toy and a receptacle in which the toy is used. The Cartesian diver is improved by including as part of the air chamber of the diver an invaginated section which is convoluted and is capable of extending and shortening in direct response to fluid pressure outside of the air chamber. The receptacle is improved by incorporating means allowing essentially complete purging of air from within the receptacle.

Many Cartesian diving toys are known. The majority of the earlier Cartesian diving toys were limited to rising and falling in a vertical manner within a body of a suitable fluid, such as water. The Cartesian diving principle was utilized in these toys to change their density with respect to the liquid they were suspended in by moving a portion of that liquid in and out of the toy, depending on the pressure of the suspending liquid. In U.S. Pat. No. 2,345,243 a Cartesian diving toy was described which, in addition to performing simple vertical up and down movements, was capable of exhibiting certain other movements. This toy was equipped with a small metal bellows to which a weight was attached. As the bellows moved in response to pressure in the surrounding fluid, the weight was displaced within the body to change the center of gravity such that the body (a human figure) when descending was oriented with its head down and when ascending had its head raised.

In attempts to better mimic the actual movement of an aquatic animal and/or a diver, improvements were made in U.S. Pat. No. 3,071,375 to Cartesian diving toys. In this patent a fish was equipped with a body having spring members located on each of its sides. These spring members extended to and attached to the tail. By increasing and decreasing the pressure of the suspending liquid in which the fish was placed, the tail of the fish was caused to move sideways and thus better mimicked the actual movement of a fish.

In a further improvement to a Cartesian diving toy, U.S. Pat. No. 3,382,606 described a diving bell type action figure. A horizontal component of movement was introduced into the Cartesian diver of this patent by incorporating a small propeller attached to a chamber which was caused to spin by discharge of water through a jet in response to decrease of pressure in the suspending liquid.

In U.S. Pat. No. 3,924,350 the Cartesian diving principle was further refined such that a small aquatic object, a fish, was able to be directed within the suspending liquid in such a manner that it more clearly mimicked the swimming action of an actual fish. In this patent, horizontal movement of the fish was accomplished via movement of a diaphragm in response to a pressure differential set up in the suspending liquid. The movement of the diaphragm was linked via a bell crank to the tail fin of the fish causing the tail of the fish to move about the laterial axis of the toy to propel the fish. In addition to improvements to the Cartesian diver, in this patent, improvements were also made to the tank which held the suspending liquid. These improvements were directed to a method which facilitated removal of the gas within the tank.

It is considered advantageous for the suspending liquid to be gas free such that the gas contained within the Cartesian diver itself will be the only gas which is expanded or contracted with respect to a pressure differential within the suspending liquid. In this way all of the energy in expanding or contracting of the gas by the suspending liquid can be utilized by the Cartesian diving toy to move the propulsion member of the toy. If, in fact, other gas exists within the suspending liquid, higher pressure differentials must be exerted on that liquid in order to accomplish the same amount of movement of the Cartesian diver.

While it is considered that the disclosures of the above U.S. patents are very utilitarian, at least in two areas certain problems related to Cartesian diver toys have not been solved. The first of the problems is directed to membranes separating the air chambers of the divers from the supporting liquids and the second problem is directed to removing gas from within the receptacle wherein the Cartesian diver is used.

The prior known Cartesian diver toys have utilized stretchable membranes to divide their air chambers from the supporting liquids. Unfortunately, these membranes are not uniform in response to pressure gradients created within the supporting liquids. When the membrane is essentially unstretched, its movement in response to a pressure differential created in the supporting liquid is different than when it is streteched. Once the membrane is stretched it offers resistance to further stretching. Additionally, a temperature increase in the supporting liquid will cause deviation of any linkages attached to the membrane from a neutral or centralized position. If these linkages are so deviated when a true response or movement of these linkages is desired upon changing of the pressure in the supporting liquid the linkage is incapable of fully responding. Further, the membranes often deform asymmetrically relative to their center line in a back and forth direction. Any linkages connected to such an asymmetric deviating membrane, of course, will not operate properly.

With regard to degassing of the container or receptacle utilized to hold the supporting liquid, U.S. Pat. Nos. 3,071,375 and 3,382,606 are silent as to how the last amounts of gas are eliminated from within their reservoirs. U.S. Pat. No. 3,924,350 makes significant steps to eliminate gas from their reservoir. A stopper is described in this patent which is purported to perform this function. The pressure bulb utilized to create a pressure gradient within the suspending liquid within the reservoir, however, does not benefit from the placement or shape of the stopper utilized to purge the reservoir. The connection between the pressure bulb and the stopper occurs at the lowest point in the pressure bulb conduit system. Therefore, it is impossible for gas to excape upwardly out of the pressure bulb. Since it is physically impossible for both the pressure bulb and the reservoir to be inverted at the same time such that the stopper is at the highest point with respect to each of them and can degas both of them, only one of them at a time can be purged of gas.

BRIEF DESCRIPTION OF THE INVENTION

In view of the above discussion, it is the object of this invention to provide a Cartesian diving toy which is capable of having its reservoir, including its external pressurizing system, completely purged of gas in an easy, one step operation. It is a further object of this invention to provide a Cartesian diver to be utilized with the above noted reservoir which has a separation membrane separating the gas chamber and the suspending liquid which is convoluted and therefore subject to a linear response with regard to pressure in the suspending liquid. It is a further object to provide a Cartesian diving toy which, because of its engineering and construction, is simple to manufacture and thus economical to the consumer. It is a further object to provide a Cartesian diving toy in which the Cartesian diver is in the shape of an aquatic animal and is very responsive to small pressure changes within the reservoir such that the Cartesian diver is capable of performing exact and intricate movements in both a horizontal and vertical direction.

These and other objects as will become evident from the remainder of this specification are achieved in a toy Cartesian diver which comprises: a diver housing; an air chamber located in said housing, said air chamber having imperforate unitary walls, a section of said wall forming as essentially rigid outer shell, the remaining section of said wall invaginated within said outer shell, at least a portion of said invaginated section of said wall being convoluted and capable of moving about its convolutions to elongate or shorten said invaginated section of said wall; the volume of said chamber decreasing and increasing in response to elongation and shortening of said invaginated section of said wall; a propulsion means movably mounted on said housing and capable of moving with respect to said housing, said propulsion means operatively connected to said invaginated section of said wall such that said propulsion means moves with respect to said housing in response to elongation and shortening of said invaginated section of said wall; said toy capable of being immersed in an essentially noncompressible liquid in response to pressure increases in said liquid said invaginated section of said wall elongating to decrease the volume of said chamber and in response to pressure decreases in said liquid said invaginated section of said wall shortening to increase the volume of said chamber, said toy moving in said liquid in response to movement of said propulsion means.

Further, improvements in the receptacle are achieved in said receptacle including an imperforate fluid container, said imperforate fluid container having a hollow interior, said hollow interior capable of containing said toy Cartesian diver, at least a portion of said container shaped as an essentially upstanding continuous container wall, said container wall having an inside and an outside container wall surface, the uppermost periphery of said container wall forming an upper orifice for egress and ingress into said container, said container including a lower orifice located within the lower periphery of said container; a pump means, said pump means located in association with said container, said pump means having an imperforate pump chamber, the volume of said chamber variable in response to activation of said pump means, the interior of said pump chamber connecting to the lower orifice of said chamber forming a fluid passageway between said pump chamber and the interior of said chamber; a stopper means, said stopper means capable of reversibly fitting onto and sealing against said upper orifice of said container, said stopper means including a downwardly protuberance means, said protuberance means sized and spaced to fit within said container wall and be spaced away from the inside surface of said container wall so as to form a narrow cavity between said container wall and said protuberance means when said stopper means is fitted onto said upper orifice of said container.

In the preferred form of the Cartesian diver toy, the propulsion means will include a bell crank member shaped as a thin flat body, i.e., the tail fin of a fish. The conneting means comprises a rod movably connected between the invaginated section of the wall is transferred to the bell crank via this rod. The invaginated section of the wall will elongate with respect to a pressure increase in the suspending liquid of the reservoir. Further, this invaginated section will shorten in response to a decrease in this pressure. An anchor member can be fixedly attached to the invaginated section of this wall to connect the rod to.

In the preferred embodiment of the receptacle, the wall located at the uppermost periphery of the fluid container will be threaded on its outside and the stopper will include a matching thread such that the stopper can be threaded onto the wall. Preferredly, the protrusion means will be in the form of a solid of revolution, such as a truncated cylinder, a truncated cone, or other similar solids of revolution. The pump means preferredly includes a flexible bellows which communicates directly with the container and pressurizes or depressurizes the container in response to movement of the bellows.

BRIEF DESCRIPTION OF THE DRAWINGS

This invention will be better understood when taken in conjunction with the drawings wherein.

Figure 1:
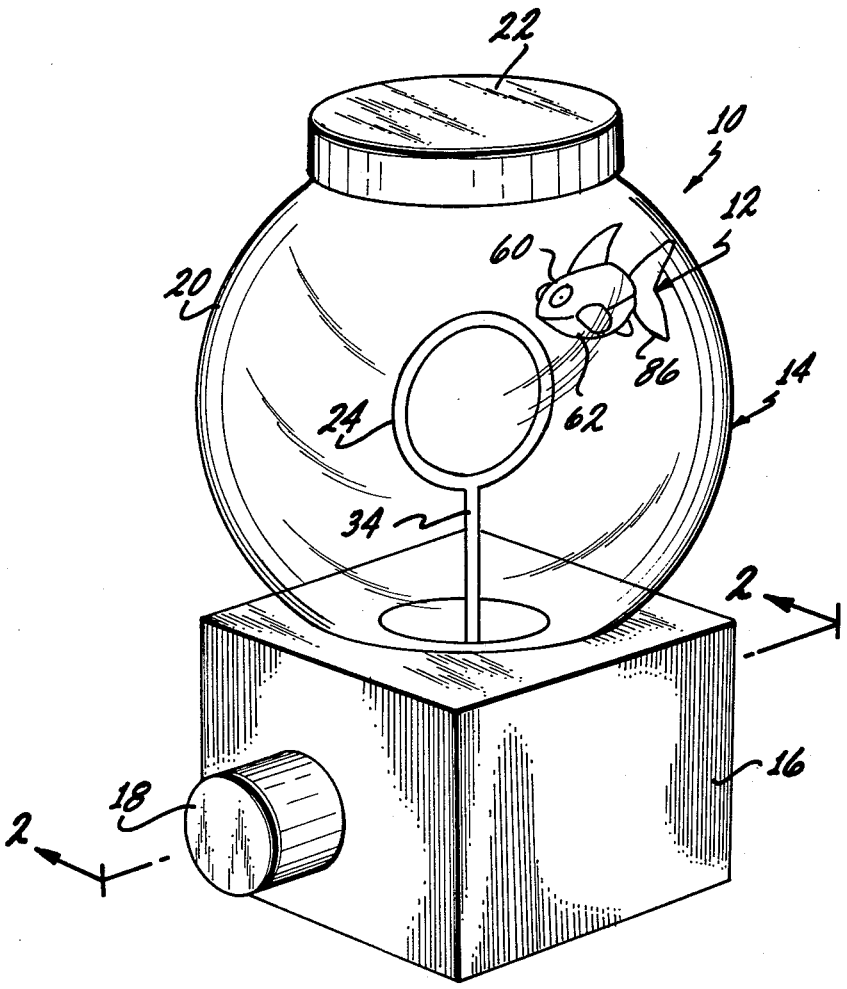
FIG. 1 is an isometric view of the complete toy of the invention.

The invention described in this specification and illustrated in the drawings utilizes certain concepts and/or principles as are set forth in the claims appended to this specification. Those skilled in the toy arts will realize that these principles and/or concepts are capable of being expressed in a variety of embodiments differing from the exact illustrative embodiment herein. For this reason, this invention is not to be construed as being limited to the exact illustrative embodiment, but should be considered only in view of the claims.

DETAILED DESCRIPTION OF THE INVENTION

The toy 10 of the invention can be divided into two parts. The first, the Cartesian diver portion 12, hereinafter referred to as the Cartesian diver, and the receptacle portion 14. The Cartesian diver 12 is in the form of a fish complete with the proper anatomical members mimicking a fish. Insofar as this invention is directed to the working components of the Cartesian diver 12 and not to its external appearance, most of the external appearance of the Cartesian diver 12 need not be described.

The receptacle 14 is composed of a base 16. Projecting out of the base 16 is a button 18. Located on the toy of the base 16 is a spherical container 20. On top of the spherical container 20 is a cap 22. The spherical container 20 is made of a transparent material allowing viewing of the Cartesian diver 12 therein. Located inside of the container 20 is an upstanding supported ring 24.

In playing with the toy of the invention, the operator of the toy manipulates the button 18 causing pressure differentials to occur within the fluid 26 located within the container 20. These pressure differentials cause the Cartesian diver 12 to move upwardly and downwardly as well as in a forward motion either turning right or left depending on manipulation of the button 18. The operator, on obtaining a certain level of skill in operating the toy 10, can cause the diver 12 to move within the container 20 such that the diver 12 will move in and out of the supported ring 24 as well as do other maneuvers within the container, much like a real live fish in a fishbowl. Water is normally chosen as the liquid 26 to be used within the container 20.

A portion 28 of the container 20 extends into the base 16. The portion 28 has a widened section 30 allowing the container 20 to be firmly mounted within the base 16. The base 16 normally would be formed as split halves allowing it to be appropriately located around the portion 28 of the container 20. The split halves (not separately identified or numbered) of the base 16 are preferredly connected via solvent welding, screw or the like. A plurality of flanges, collectively identified by the numeral 32, are located within the base 16. These flanges fit around the widened section 30 of the container 20 to firmly hold the container within the base 16.

The supported ring 24 is mounted on an upstanding rod 34. The rod 34 is in turn mounted on a disk 36 having a plurality of holes 38. The disk 36 snugly fits within the widened section 30 of the container 20 to fixly hold the ring 24 in an upright manner. The holes 38 in the disk 36 allow for appropriate fluid flow between the area of the container 20 above and below the disk 36. the size of the opening of the ring 24 is sufficient to allow passage of the Cartesian diver 12 through the opening in the disk allowing for the operator of the toy to perform stunts and other maneuvers with the Cartesian diver 12.

An L-shaped tube 40 is appropriately located between two flanges collectively identified by the numeral 42 within the base 16. One end of the tube 40 fits through an opening or lower orifice (not separately identified or numbered) in the bottom of the container 20. The bottom of the container 20 is sealed against the tube 40 such that a fluid tight seal exists between the tube 40 and the container 20. The other end of the tube 40 is inserted into and sealed against a bellows 44. The bellows 44 acts as a pump chamber for increasing or decreasing the fluid pressure within the container 20. The button 18 fits over the bellows 44. The button 18 includes a flange 46 which prevents the button 18 from being completely withdrawn from the base 16. This limits the outward extension of the bellows 44. Depression of the button 18 into the base 16 results in compression of the bellows 44 and discharge of any fluid therein through the tube 40 into the container 20. Releasing of the button 18 allows the fluid pressure to return the bellows 44 to an extended position. The bellows 44 is preferredly made out of a plastic material having an inherent elastic property therein which tends to return it to an extended position such that the flanges 46 on the button 18 are located against the side wall of the base 16.

Figure 2:
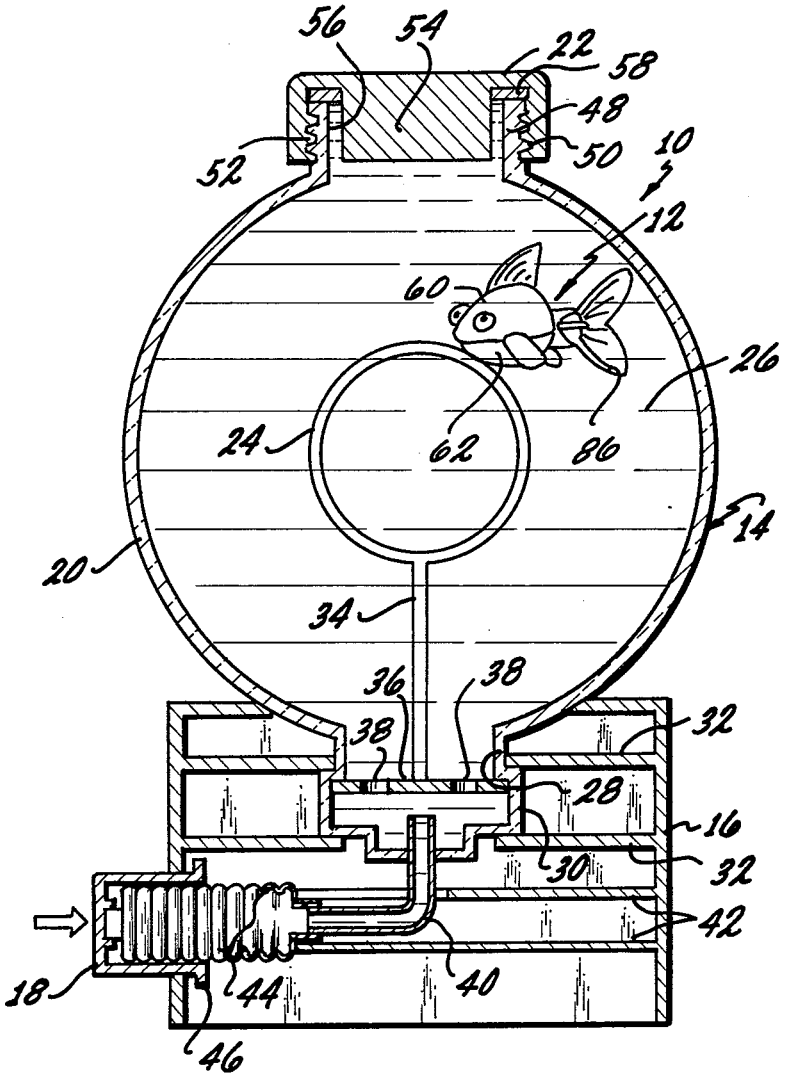
FIG. 2 is a side elevational view in partial section of the toy shown in FIG. 1.
Figure 3A:
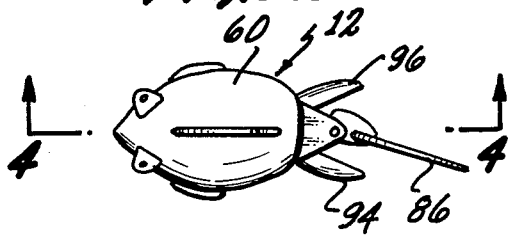
FIGS. 3*a, b & c* are top plan, side elevational and rear elevational views of the fish component seen in FIGS. 1 and 2.
Figure 3B:
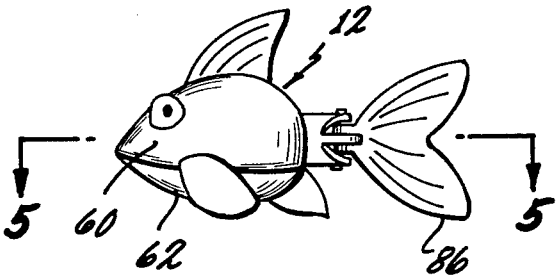
Figure 3C:
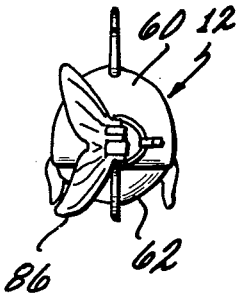
Figure 4:
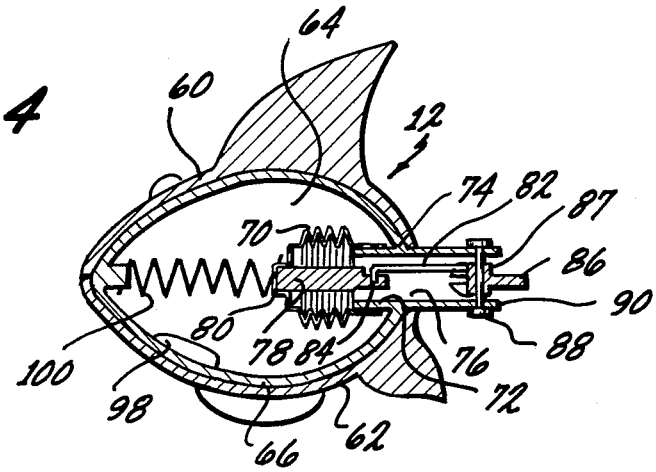
FIG. 4 is a side elevational view in section about the line 4—4 of FIG. 3*a;*

The upper portion of the container 20 is formed as an upstanding circular wall 48. On the outside surface of this wall are threads 50. These threads are capable of mating with threads 52 formed on the inside of cap 22. Within the center of the cap 22 is a protrusion 54. The protrusion as seen in FIG. 2 is shaped as a portion of a cylinder. The cylindrical, or some other surface of revolution, is sized such that it is spaced away from the inside 56 of the wall 48. A washer 58, or other sealing means, is located within the cap 22 at the base of the protrusion 54. The washer 58 will form a fluid tight seal with the top of the wall 48 when the cap 22 is appropriately screwed down to the container 20.

The toy 10 is capable of being readily and rapidly filled with water and utilized for a period of time and then emptying for storage or transportation, if desired. The toy 10 incorporates certain features which allow for filling of the container 20 with fluid in such a manner that any gas within the container 20, and also within the bellows 44 and the tube 40, is easily purged. It is noted that the bellows 44 and the tube 40 are located at the lower extremity of the container 20 when the container 20 is in an upright position. When water is first introduced into the container 20 it is easy to purge the bellows 44 and the tube 40 of gas by simply pumping it several times. This allows for a rapid and convenient exchange of any gas located therein with water. By so locating the opening of the bellows 44 and the tube 40 in the bottom of the container 20, the problem experienced with certain prior art devices of degassing the pumping system has been overcome.

The container 20 is completely filled with water. The bellows 44 and tube 40 can be degassed upon partial filling or after complete filling. In any event, after degassing of the bellows 44 and the tube 40, the container 20 is filled with water up to a level such that the height of the water is at the top of the wall 48. If the Cartesian diver 12 has not previously been inserted into the container 20 prior to filling, it is done at this time. In any event, with the water level up to the top of the wall 48 the cap 22 is inserted onto the container 20. The protrusion 54 goes through the upper orifice (not separately identified or numbered) formed by the top of the wall 48 and displaces a certain volume of water equal to its volume. This volume of water will exit over the top of the wall 48. The fit between the threads 50 and 52 is sufficiently loose such that any fluid, i.e., gas or liquid, being displaced from the container 20 is allowed to escape between the threaded members. As the protrusion 54 pushes down into the container 20 with screwing of the cap 22 onto the wall 48, all gas, being lighter than liquid, is displaced from the container 20 and when the washer 58 seats itself onto the top of wall 48 the only thing remaining inside the container 20 is liquid (of course, we are neglecting any gas within the Cartesian diver 12 itself). It can thus be seen that the combination of having the pressurizing means, i.e., the bellows 44, located at the bottom of the container 20 and the protrusion 54 within the cap 22 successfully allows for completely degassing of the interior of the container 20. It is, or course, important that the protrusion 54 be spaced away from the side wall 48 to allow for an avenue of escape for any gas located within the container 20.

Referring now to FIGS. 3 through 6, the Cartesian diver 12 will be described in detail. The diver 12 has an outside housing split into a top section 60 and a bottom section 62. These are appropriately mated by solvent welding or the like after the internal components hereinafter explained have been located therein. Inside of the housing components 60 and 62 is an air chamber 64. The air chamber 64 (after it is constricted) has a continuous wall having an outside rigid outer shell 66 and an invaginated internal portion 68. The invaginated portion 68 is composed of a convoluted bellows 70 which is located on the end of a tube 72. The surface formed by the outside wall 66, the tube 72 and the bellows 70 forms a imperforate wall through which there is no normal gas or liquid exchange. Where the ends 74 of the tube 72 meets with and is joined with the outer shell 66 a circular orifice 76 is formed. As can be best seen in FIGS. 5 and 6, the orifice 76 allows for liquid from within the container 20 to flow within the interior of the tube 72 and bellows 70.

Together the inside of shell 66, the outside of the bellows 70 and the outside of the tube 72 form the air chamber 64. The outside of shell 66, the inside of bellows 70 and the inside of tube 72 are therefore exposed to the liquid environment with container 20.

The bellows 70 is convoluted. Being convoluted it is susceptible to elongation and for shortening away from and toward the orifice 76. Since its elongation and shortening is by virtue of its convolution, the pressure necessary to do this is essentially linear through the stroke of the bellows 70. Because the bellows 70 and the tube 72 are invaginated within the outside shell 76, pressure increases in the environment within the container 20 cause elongation of the bellows 70 and the pressure decreases in the environment within the container 20 cause shortening of the bellows 70.

An anchor member 78 is appropriately solvent welded to the end or apex 80 of the bellows 70. The anchor member 78, therefore, will move as the bellows 70 expands and shortens. A rod 82 is pivotly mounted to anchor member 78 by insertion into a hole 84. The tail fin 86 of the Cartesian diver 12 is formed as a portion of a bell crank 87. Bell crank 87 is pivotly mounted via a pin 88 in appropriate holes (not separately numbered or identified) within extension 90 of the housings 60 and 62 forming the outside of the Cartesian diver 12. The other end of the rod 82 is appropriately pivotly mounted in a hole 92 formed in the bell crank 87. Movement of the bellows 70 is transferred via the anchor member 78 to the rod 82 which in turn rotates the bell crank 87 and, therefore, tail 86 about the pin 88.

Figure 5:
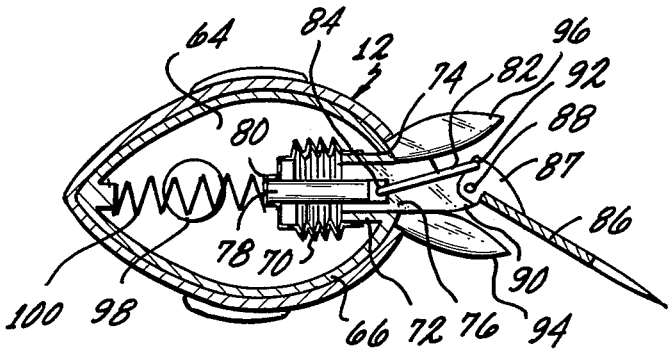
FIG. 5 is a plan view in section about the line 5—5 of FIG. 3*b;*
Figure 6:
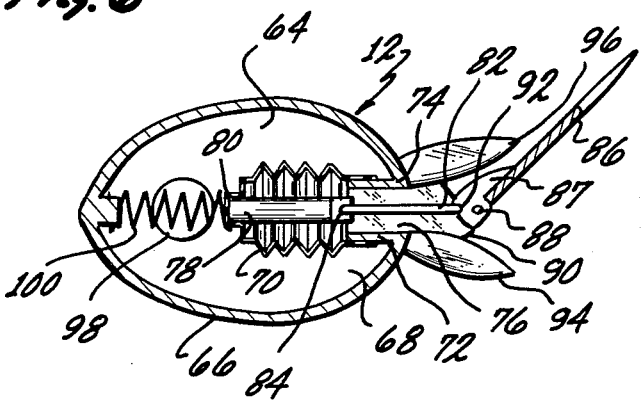
FIG. 6 is a view similar to FIG. 5 except one outside component has been removed and other components are located in a different spacial relationship with respect to that seen in FIG. 5.

As can be seen in FIGS. 5 and 6, when the bellows 70 is shortened upon reducing the pressure within the container 20, the rod 82 is extended out of the orifice 76 and the tail 86 is moved to the left. When the bellows 70 is elongated upon increase of pressure within the container 20, the rod 82 is drawn into the orifice 76 bringing the tail to the right. Two members 94 and 96 respectively limit the travel of the tail 86 to the left and right. These members are an extension of the housing components 60 and 62 shaped as appropriate fins on the lateral sides of the Cartesian diver 12. As the tail oscillates to the left and right, as hereinafter described, its broad flat shape causes propulsion of the Cartesian diver 12 through the suspending liquid within the container 20.

A weight 98 is appropriately located in the forward bottom portion of the air chamber 64 to appropriately balance and orient the Cartesian diver 12 within the container 20. Optionally included within the air chamber 64 is a spring 100. The spring 100 is a compression spring and will tend to urge the bellows 70 to the compressed state as seen in FIG. 5. Normally the bellows 70 is made out of a plastic material such as polyethylene. Although while located within a liquid environment within the container 20, the plastic material is not gas premeable, if in fact the Cartesian diver 12 is left outside in the air for an extended period of time there can be gas exchange across the wall of the air chamber 64. Normally the air chamber 64 is sealed during construction such that the bellows 70 is in a shortened state as seen in FIG. 5. This is the result of a small pressure within the air chamber 64. If the air chamber 64 is left exposed to a gaseous environment i.e., the air, there can be some movement of air from within the air chamber 64 to the outside environment upsetting the air equilibrium within the air chamber 64 as manufactured. By incorporation of the spring 100 within the air chamber 64 the bellows will be shortened, as seen in FIG. 5, whenever a pressure reduction occurs outside of the Cartesian diver 12, as for instance, the Cartesian diver 12 is left outside of a liquid environment and is exposed simply to an air environment. By shortening the bellows 70 the air pressure inside of the air chamber 64 is maintained at its correct pressure for proper operation of the Cartesian diver 12 with a liquid.

When the Cartesian diver 12 is placed within a water environment in the container 20, it will be maintained in a nearly horizontal position by virtue of placement of the weight 98 and the air within the air chamber 64. If the button 18 on the base 16 is fully extended outside of the base 16, the pressure within the container 20 is such that the Cartesian diver 12 floats in an upright position near the top of the container 20. When the button 18 is depressed inwardly, the hydraulic pressure within the water in container 20 is increased by virtue of container 20 being a totally sealed container. When this happend, the bellows 70 is elongated away from the orifice 76 compressing the volume of air within the air chamber 64. When this is done, the buoyancy of the Cartesian diver 12 is reduced and it sinks. The depth to which it sinks to will be completely variable depending upon the pressure induced within the container 20. Upon relieveing of the pressure within the container 20 by release of the button 18, the Cartesian diver 12 will rise because of shortening of the bellows 70 toward the orifice 76 increasing the volume within the air chamber 64 and thus making the Cartesian diver 12 more bouyant.

Along with the vertical movement of the diver 12, activation of the button 18 also causes forward movement of the diver 12 as follows. When the bellows 70 elongates in response to increased pressure within the container 20, the elongation of the bellows 70 is communicated to the tail 86 as herefore described. This causes the tail 86 to move to the right. If the button 18 is quickly depressed, there is a very quick rise of pressure within the container 20 and the tail 86 will move rapidly to the right causing the Cartesian diver 12 to be propelled forward. By suddenly releasing the button 18 the pressure is reduced in the container 20 causing the tail 86 to swing the left suddenly also propelling the Cartesian diver 12 in a forward manner. If the button 18 is slowly oscillated in and out through only a small limit of its extent of its travel, the Cartesian diver 12 will be maintained at an almost constant height within the container 20, but the tail 86 will oscillate with a short stroke in response to the button movement 18 causing swimming motion of the diver 12. By holding the button in a depressed state the tail is maintained to the right and the diver 12 will turn to the right; and by releasing the button the tail is maintained to the left causing the diver 12 to turn to the left. Because of the complete evacuation of the container 20 of all gas, the movement of the Cartesian diver 12 is very responsive to the button 18.

Normally, the toy 10 is sized such that the user of the toy can conveniently place his hand around the base 16 with the thumb resting on the button 18. By appropriately concealing the button 18 beneath the thumb, it is very difficult to other observers to ascertain the movement of the thumb and the button 18 and the Cartesian diver 12 appears to be a live fish swimming in a fishbowl. By a combination of rapid oscillations of the button 18 interspaced with slower oscillations of the button 18 the Cartesian diver 12 can be made to swim forward, upwardly and downwardly, go in circles in either direction and even be made to go through the ring 24. Because the bellows 70 is convoluted and its stretching and shortening is almost linear with pressure changes within the container 20, the operator of the toy 10 can quickly master certain skills in using the toy 10 such that the Cartesian diver 12 can be moved in a very real lifelike manner within the liquid within the container 20.

We claim:

1. A toy Cartesian diver which comprises:

a diver housing;

an air chamber located in said housing, said air chamber having imperforate unitary walls, a section of said walls forming an essentially rigid outer shell, the remaining section of said walls formed as an elongated surface invaginated within said outer shell, at least a portion of said invaginated sections of said walls being permanently convoluted and capable of moving about its convolutions to elongate or shorten said invaginated section of said walls;

the volume of said chamber decreasing and increasing in response to elongation and shortening repeatedly of said invaginated section of said walls;

a propulsion means movably mounted on said housing and capable of moving with respect to said housing, said propulsion means connected to said invaginated section of said walls such that said propulsion means moves with respect to said housing in response to elongation and shortening of said walls;

said toy capable of being immersed in an essentially noncompressible liquid and in response to pressure increases in said liquid in said invaginated section of said walls elongating to decrease the volume of said chamber and in response to pressure decreases in said liquid said invaginated section of said walls shortening to increase the volume of said chamber, said toy moving in said liquid in response to movement of said propulsion means.

2. The toy of claim 1 wherein:

said propulsion means includes a bell crank member and a connecting rod;

said bell crank member pivotally mounted on said housing, a portion of said bell crank member formed as a thin flat body;

said connecting rod movably mounted between said invaginated section of said wall and said bell crank member, said connecting rod transferring movement of said invaginated section of said wall to said bell crank member.

3. The toy of claim 2 including:

said outer shell having an aperture in its surface and said invaginated section of said wall connecting around said aperture such that the interior of said invaginated section is connected to the ambient environment exterior of said air chamber;

said invaginated section of said wall elongating away from said aperture in response to increase in pressure in the ambient environment exterior of said air chamber and said invaginated section of said wall shortening towards said aperture in response to decrease in the pressure in the ambient environment exterior of said air chamber.

4. The toy of claim 3 including:

an anchor member fixedly attaching to the interior of the invaginated section of said interior wall at an apex point distal to said aperture, said connecting rod pivotally mounted to said anchor member movably connecting said rod to said invaginated section of said wall.

5. The toy of claim 4 including:

a compression spring located in the interior of said air chamber on the inside of said outer shell between a point on said outer shell distal from said aperture and the apex of said invaginated section of said wall.

6. The toy of claim 5 wherein:

said housing is shaped as an aquatic animal and said portion of said bell crank member formed as a thin flat body is shaped as an appendage of said animal utilized by said animal for propulsion.

7. The toy of claim 1 including:

a receptacle for said Cartesian diver;

said receptacle including an imperforate fluid container, a pump means and a stopper means;

said imperforate fluid container having a hollow interior, said hollow interior capable of containing said toy Cartesian diver, at least a portion of said container being transparent, the uppermost portion of said container shaped as an essentially upstanding continuous container wall, said container wall having an inside and an outside container wall surface, the uppermost periphery of said container wall forming an upper orifice for egress and ingress into said container, said container including a lower orifice located within the lower periphery of said container;

said pump means located in association with said container, said pump means having an imperforate pump chamber, the volume of said chamber variable in response to activation of said pump means, the interior of said pump chamber connecting to the lower orifice of said container forming a fluid passageway between said pump chamber and the interior of said container;

said stopper means capable of reversibly fitting onto and sealing against said upper orifice of said container, said stopper means including a downwardly protuberance means, said protuberance means sized and spaced to fit within said container wall and be spaced away from the inside surface of said container wall so as to form a narrow cavity between said container wall and said protuberance means when said stopper means is fitted onto said upper orifice of said container;

said container capable of holding a quantity of said essentially noncompressible liquid;

said pump means capable of increasing and decreasing the pressure of said essentially noncompressible liquid within said container.

8. the toy of claim 7 wherein:

said container wall includes a first set of threads on said outside container wall surface;

said stopper means includes a second set of threads, said second set of threads capable of interlocking with said first set of threads maintaining said stopper means on said container.

9. The toy of claim 8 wherein:

said protuberance means is shaped as a solid of revolution.

10. The toy of claim 9 wherein:

said imperforate chamber comprises a bellows.

11. The toy diver of claim 1 wherein:

said remaining section of said walls comprises a bellows, said bellows attached to and projecting within said outer shell such that the interior of said bellows is connected to the ambient environment exterior of said air chamber allowing said liquid to fill said interior of said bellows.

* * * * *